US009037045B2

(12) United States Patent
Gila et al.

(10) Patent No.: US 9,037,045 B2
(45) Date of Patent: May 19, 2015

(54) CHARGE ROLLERS AND APPARATUS INCLUDING CHARGE ROLLERS

(75) Inventors: Omer Gila, Cupertino, CA (US); Michael H. Lee, San Jose, CA (US); Seongsik Chang, Santa Clara, CA (US); Tom Anthony, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 41 days.

(21) Appl. No.: 13/981,861

(22) PCT Filed: Feb. 4, 2011

(86) PCT No.: PCT/US2011/023825

§ 371 (c)(1),
(2), (4) Date: Jul. 25, 2013

(87) PCT Pub. No.: WO2012/105987

PCT Pub. Date: Aug. 9, 2012

(65) Prior Publication Data

US 2013/0308982 A1 Nov. 21, 2013

(51) Int. Cl.
*G03G 15/02* (2006.01)

(52) U.S. Cl.
CPC ..... *G03G 15/0233* (2013.01)

(58) Field of Classification Search
USPC ..... 399/176
See application file for complete search history.

(56) References Cited

U.S. PATENT DOCUMENTS

| | | | | |
|---|---|---|---|---|
| 4,371,252 | A * | 2/1983 | Uchida et al. | 399/175 |
| 4,380,384 | A * | 4/1983 | Ueno et al. | 399/176 |
| 5,745,820 | A | 4/1998 | Iwakura et al. | |
| 5,768,653 | A | 6/1998 | Fare | |
| 5,970,302 | A * | 10/1999 | Yamane | 399/343 |
| 5,974,277 | A * | 10/1999 | Yamane et al. | 399/50 |
| 6,381,432 | B1 * | 4/2002 | Hattori | 399/176 |
| 6,909,859 | B2 | 6/2005 | Nakamura et al. | |
| 7,298,993 | B2 | 11/2007 | Lee et al. | |
| 7,756,439 | B2 | 7/2010 | Kosuge et al. | |
| 2008/0166154 | A1 * | 7/2008 | Watanabe et al. | 399/174 |
| 2010/0092204 | A1 | 4/2010 | Askren et al. | |

(Continued)

FOREIGN PATENT DOCUMENTS

| | | |
|---|---|---|
| JP | 64-073367 | 3/1989 |
| JP | 6222649 | 8/1994 |

(Continued)

OTHER PUBLICATIONS

International Bureau, "International Search Report", issued in connection with PCT application No. PCT/US2011/023825, mailed Oct. 28, 2011, (3 pages).

*Primary Examiner* — G. M. Hyder
(74) *Attorney, Agent, or Firm* — Hanley, Flight & Zimmerman

(57) ABSTRACT

Printers, methods, and apparatus to form an image on a substrate are disclosed. An example disclosed charge roller includes a dielectric outer layer (104) comprising an inner surface (106) and an outer surface (108), the outer surface (108) to be charged by a first external surface and to discharge onto a second external surface, and the dielectric outer layer (104) to substantially prevent charge transfer between the inner surface (106) and the outer surface (108), and an electrically conductive inner layer (102) to direct electrical charge toward and away from the inner surface (106) of the outer layer (104), and to be coupled to an electrical source to control a transfer of the electrical charge.

20 Claims, 7 Drawing Sheets

(56) References Cited

U.S. PATENT DOCUMENTS

| | | | | |
|---|---|---|---|---|
| 2010/0166459 | A1 | 7/2010 | Kawashima | |
| 2010/0296851 | A1* | 11/2010 | Toyooka et al. | 399/388 |
| 2010/0296852 | A1* | 11/2010 | Higaki | 399/390 |

FOREIGN PATENT DOCUMENTS

| | | |
|---|---|---|
| JP | H087485 | 1/1996 |
| JP | 2001-034040 | 2/2001 |

* cited by examiner

CHARGE ROLLERS AND APPARATUS INCLUDING CHARGE ROLLERS

BACKGROUND

Electrophotographic printers include photo imaging members such as photoconductive drums. The photoconductive drums are electrically charged and discharged to attract inks in a particular pattern. The photoconductive drums deposit the inks directly onto a print substrate or via an offset drum, and the inks are then fixed to the substrate to output a hard image.

BRIEF DESCRIPTION OF THE DRAWINGS

Wherever possible, the same reference numbers will be used throughout the drawing(s) and accompanying written description to refer to the same or like parts.

DETAILED DESCRIPTION

Figure 1:
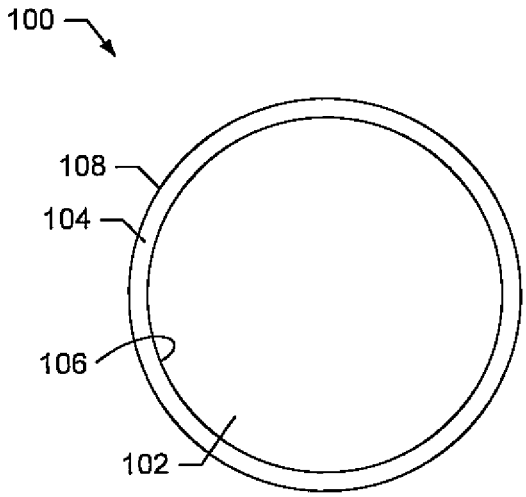
FIG. 1 illustrates an end view of an example charge roller in accordance with teachings disclosed herein.

In electrophotographic printers, a photo imaging plate (also referred to as a photo imaging surface or a photo imaging member) is charged with a uniform charge by a charge roller. Known charge rollers are consumable products, and may have lifespans less than 750,000 impressions. Some known charge rollers use ionic conduction to evenly transfer charge from the charge roller to the photo imaging plate. The materials that provide the ionic conduction are affected by currents that alter the physical properties of the material over time and eventually alter the charge applied to the photo imaging plate and/or cause the charge to be applied unevenly, at which point the charge roller must be replaced. Some known charge rollers use conductive materials to transfer the charge to the photo imaging plate. Concentrated electrical currents tend to follow particular paths through the material in these charge rollers, which causes local hot spots in the material. These hot spots result in pinholing on the photo imaging plate, which reduces the life of the photo imaging plate, and the image quality. Some known charge rollers use somewhat less conductive materials to coat the roller (having resistivities up to about $10^9$ Ohm-centimeters (cm)) to reduce the likelihood of pinholing but tend to suffer from poor charging uniformity.

Example charge rollers and apparatus disclosed herein include a conductive inner layer and a dielectric outer layer to provide a uniform or substantially uniform electric charge to a photo imaging plate. Some example charge rollers disclosed herein include the dielectric outer layer, the conductive inner layer, and a conductive core. Example conductive cores disclosed herein are constructed using a metal such as aluminum or stainless steel. Example conductive inner layers disclosed herein are constructed using a conductive rubber (e.g., a conductive rubber doped with carbon) having a resistivity between about $1\times10^{-6}$ Ohm-cm and about $1\times10^{5}$ Ohm-cm, although other resistivities may be used. By using a material having a lower resistivity (e.g., a higher conductivity) for the inner layer and a dielectric outer layer, example charge rollers disclosed herein provide a more uniform charge or voltage distribution to an external surface to be charged.

Example dielectric outer layers disclosed herein have an inner surface (e.g., adjacent the inner layer) and an outer surface (e.g., opposite the inner surface) and are constructed of a dielectric material having a high electrical breakdown strength (e.g., greater than about 100 Volts per micrometer (V/μm)) and/or a high resistivity (e.g., greater than about $5\times10^{12}$ Ohm-cm). By using a material having high electrical breakdown strength, disclosed example outer layers prevent undesirable pinholing when using a conductive inner layer. By using a material having a high resistivity, disclosed example outer layers also prevent or substantially prevent currents that may cause depletion of the inner layer and/or substantial reduction in print quality. In some disclosed examples, the outer layer prevents more than 1 percent of current used to charge an external surface from transferring through the outer layer. Additionally, unlike known charge rollers, some example charge rollers disclosed herein do not depend on a voltage applied to the conductive inner layer or core of the charge roller to establish the voltage to which the photo imaging member is charged.

Example image forming apparatus disclosed herein include a charge roller, a bias roller, and a photo imaging plate. Some disclosed examples further include a direct current (DC) source and/or alternating current (AC) source to charge the bias roller based on a desired voltage to be applied to the photo imaging plate. Some disclosed examples include a DC source and/or AC source to charge the conductive core of the charge roller. In some examples, the bias roller applies charge to the outer surface of the charge roller during operation of the image forming apparatus. The example charge roller transfers the charge to the photo imaging member to provide a substantially uniform charge to the photo imaging plate. In some examples, an external surface is considered to have a uniform charge if the upper peak-to-peak voltage difference between charged portions of the surface is less than 20 Volts (V).

Some example charge rollers disclosed herein substantially prevent electrical current from flowing between the outer surface and the inner surface of the charge roller outer layer. In some examples, the outer layer is considered to substantially prevent current flow if the current traversing the outer layer is less than about 1 percent of the current transferred from a first external surface to a second external surface via the charge roller during operation. As a result, example charge rollers disclosed herein substantially prevent current flow between the conductive core and/or the inner layer and the bias roller, and between the core and/or the inner layer and the photo imaging plate.

Example charge rollers and image forming apparatus described herein charge a surface to a negative voltage (e.g., −1000 V) with respect to a ground. As used herein, a "higher" voltage refers to a voltage that is farther from a 0 V reference than another "lower" voltage. Thus, −200 V would be described below as "higher" than −100 V because there is a larger difference in potential between −200 V and 0 V than −100 V and 0 V.

FIG. 1 illustrates an example charge roller 100. The example charge roller 100 illustrated in FIG. 1 includes a conductive inner layer 102 and a dielectric outer layer 104. The outer layer 104 has an inner surface 106 adjacent the conductive inner layer 102, and an outer surface 108 opposite the inner surface 106. The example charge roller 100 of FIG. 1 may be used, for example, in an image forming apparatus (e.g., a printer, a printing press, etc.) to apply a uniform or substantially uniform electrical charge to an external surface such as a photo imaging member.

The example inner layer 102 illustrated in FIG. 1 is constructed using a soft, conductive material such as a conductive rubber or a metal. An example conductive rubber may be Polyurethane rubber doped with a conductive additive such as carbon black, a metal salt (e.g., lithium chloride, lithium perchlorate, lithium bromide, potassium perchlorate, iron chloride, iron bromide, etc.), or a combination of carbon black and metal salt(s). Example metals that may be used include aluminum, stainless steel, copper, and/or any other metal suitable for a printing environment. The example inner layer 102 has a resistivity selected to have a low voltage drop when an electrical source is connected to the inner layer 102. The example inner layer 102 is also selected to be relatively soft yet resilient, and maintains and/or resumes an initial shape after deformation. When the example charge roller 100 is used, for example, to charge a hard photo imaging member in a printer, the softness of the rubber reduces mechanical damage to contacting parts such as the charge roller 100 and the photo imaging member.

The example inner layer 102 illustrated in FIG. 1 is constructed in a manner that provides the inner layer 102 with substantial circumferential continuity (e.g., no seams or breaks in the material). Such circumferential continuity allows the inner layer 102 to have a substantially uniform resistivity and reduces paths of current that may lead to reduced charge roller life. In some examples, the material from which the inner layer 102 is constructed (e.g., a conductive rubber having a resistivity less than $1\times10^5$ Ohm-cm) is molded to form the inner layer 102.

The example outer layer 104 in constructed using a dielectric material. In the illustrated example of FIG. 1, the outer layer 104 is constructed using a para-xylylene material or a derivative material of para-xylylene, such as Parylene-N, which has a dielectric breakdown strength of over 250 V/μm. The relatively high volume resistivity (e.g., greater than about $10^{16}$ Ohm-cm) and high dielectric strength of Parylene-N substantially prevents current from flowing through the outer layer 104 either into or out of the inner layer 102. In the illustrated example, the inner layer 102 is approximately 5 millimeters (mm) thick and the outer layer 104 is approximately 3 μm thick. However, other thicknesses (e.g., between 2 μm and 12 μm for example dielectric layer material(s) such as Parylene-N, the same or different thicknesses for other dielectric materials) may be used for the outer layer 104 based on the desired charge to be applied to an external surface, an upper voltage that could be applied across the outer layer 104 in a particular application, and/or a desired charge uniformity on the surface to be charged. In some other examples, the outer layer 104 is constructed using a material having a dielectric breakdown strength of at least 100 V/μm.

To charge an external surface (e.g., a photo imaging plate in a printer), charges are first deposited onto the outer surface 108 (e.g., by an external source). The deposited charge(s) may be negative or positive, and example apparatus and methods to deposit charge onto the outer surface 108 are described in more detail below. In some examples, charge is transferred to the outer surface 108 using a Paschen discharge, in which a voltage difference between the outer surface 108 and the surface of the external source of charge is larger than a Paschen breakdown voltage of an intermediate medium (e.g., air). This causes charges to deposit on the outer surface 108 and an adjacent external surface. Example charge transfers are also described in more detail below.

In contrast to known charge rollers, the example charge roller 100 of FIG. 1 does not suffer from electrical or chemical aging in either the inner or the outer layers. In this example, electrical conduction is used in the inner layer, as opposed to ionic conduction as is used in some known charge rollers. As a result, the inner layer maintains its conductivity and does not lose conduction due to loss of ions. Additionally, the example charge roller 100 of FIG. 1 does not suffer from pinholing, which may be caused by concentrated currents traveling through chains within a conductive inner material and resulting in too large of a voltage drop for outer layers of known charge rollers to sustain. The uniformity and the high electrical breakdown field strength of the example outer layer 104 prevents the concentrated currents from burning through outer layers of known charge rollers and arcing to the surface to be charged. Sensitive surfaces such as photoconductors or photo imaging plates in printers are then spared from exposure to the concentrated currents, which may cause permanent damage to the photoconductors or photo imaging plates and reduce image quality.

Parylene-N is advantageously used to implement the outer layer 104 in the example of FIG. 1 because Parylene-N has relatively high dielectric strength, has not been shown to suffer from electrical or chemical aging in the examples described herein, and is less costly to use as a coating on a charge roller than some other dielectric materials. In some examples, other dielectric materials may also be used to implement the outer layer 104. However, other dielectric materials may suffer from one or more of a higher cost of manufacturing and/or application to the charge roller 100, lower dielectric strength (requiring a thicker layer of dielectric material to achieve the same effect, thereby increasing the voltage required to achieve Paschen breakdown and/or reducing charging uniformity), substantial non-uniformity of the outer layer 104 thickness, and/or eventual electrical and/or chemical aging of the material, leading to a reduction in charging performance.

Figure 2:
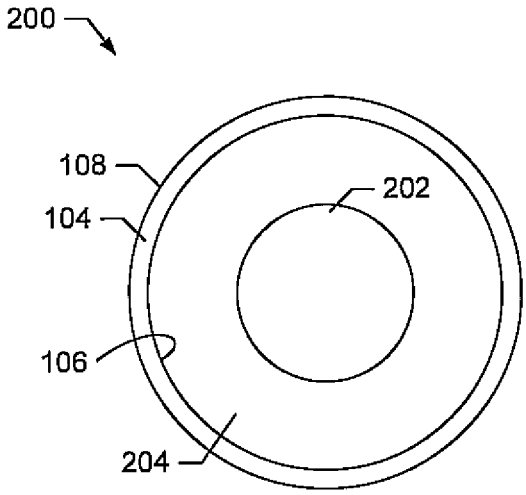
FIG. 2 illustrates an end view of another example charge roller in accordance with teachings disclosed herein.

FIG. 2 illustrates another example charge roller 200. Like the charge roller 100 of FIG. 1, the example charge roller 200 includes an outer layer 104 constructed using Parylene-N or another dielectric material with a sufficient dielectric strength and a sufficiently high resistivity. The example charge roller 200 of the illustrated example further includes a conductive core 202 and a conductive inner layer 204, which are both concentric with the example outer layer 104.

The example core 202 of FIG. 2 is constructed using a conductive material such as a metal. Example metals that may be used include aluminum, stainless steel, copper, and/or any other metal suitable for a printing environment. In some examples, the core 202 is constructed of a relatively rigid metal that is resistant to deformation when pressure is applied.

The example inner layer 204 of FIG. 2 may be similar to the inner layer 102 of FIG. 1 in materials, composition, and shape. However, the example inner layer 204 is further constructed to be positioned between the core 202 and the outer layer 104. To this end, the example inner layer 204 of FIG. 2 may be molded or cut to fit over the core 202 and to be substantially continuous in the circumferential direction. In the illustrated example of FIG. 2, the core 202 and the inner layer 204 are in contact about the circumference and along the length of the core 202.

While the example charge roller 200 of FIG. 2 may be more expensive to produce than the example charge roller 100 of FIG. 1 due to additional manufacturing steps, the example charge roller 200 is more resistant to permanent deformation, makes more reliable contact with external surfaces, and may be constructed to charge a photo imaging member more uniformly than the charge roller 100.

Figure 3A:
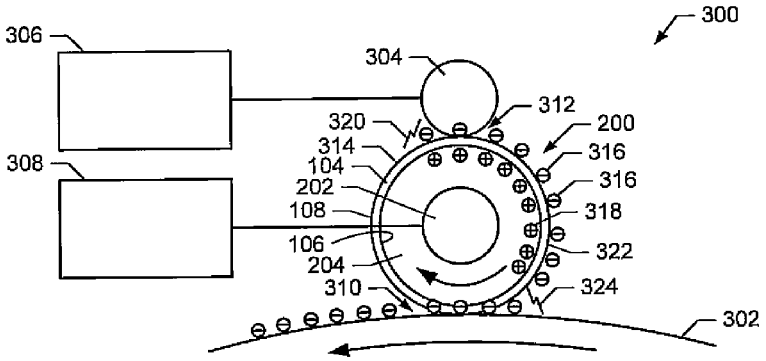
FIG. 3A illustrates an example image forming apparatus including the charge roller of FIG. 2 in a charging configuration.

FIG. 3A illustrates an example image forming apparatus 300 including the example charge roller 200 of FIG. 2 in a charging configuration. The example charge roller 200 includes the core 202, the inner layer 204, and the outer layer 104, including the inner 106 and outer 108 surfaces.

The example image forming apparatus 300 further includes a photo imaging member 302 (e.g., a photoconductor, a photo-imaging plate), a bias roller 304, and electrical sources 306 and 308. As illustrated in FIG. 3A, the example charge roller 200 is located between the bias roller 304 and the photo imaging member 302. The charge roller 200 receives a charge (e.g., negative charges) from the bias roller 304 and transfers the charge to the photo imaging member 302 to establish a desired voltage (e.g., about −1000 VDC) on the surface of the photo imaging member 302.

The example photo imaging member 302 may be a photoconductor, and/or any other type of electrophotographic surface that may be repeatedly charged and/or discharged. The photo imaging member 302 may be configured as a rotating drum and/or as an electrophotographic surface that travels along a path defined by multiple rollers. The example photo imaging member 302 of FIG. 3A is substantially rigid or hard and makes mechanical contact with the charge roller 200 at a first nip 310.

The example bias roller 304 is constructed using a metal roller. For example, the bias roller 304 may be constructed using aluminum, stainless steel, copper, and/or other metal and, thus, has substantial rigidity. The illustrated bias roller 304 of FIG. 3A makes mechanical contact with the charge roller 200 at a second nip 312. The charge roller 200, the photo imaging member 302, and/or the bias roller 304 rotate in respective directions to transfer charge from the bias roller 304 to the photo imaging member 302 via the charge roller 200. In the illustrated example, the charge roller 200 is rotated by friction caused by mechanical contact with the photo imaging member 302, which is also rotating. The bias roller 304 may rotate from friction caused by mechanical contact with the rotating charge roller 200 or may be fixed.

The example electrical source 306 of FIG. 3A is a DC source and is electrically coupled to the bias roller 304. The electrical source 306 causes the voltage of the bias roller 304 to be set to a DC voltage that is based on the desired voltage to be applied to the photo imaging member 302, the distance(s) between and/or size(s) of the bias roller 304, the photo imaging member 302, and/or the charge roller 200, and/or transfer voltage drop(s) (e.g., Paschen breakdown voltage(s)). The example electrical source 308 is an AC source and is electrically coupled to the core 202. In some examples, the electrical source 308 provides an AC component to alternate the voltage of the core 202, which causes the charge roller 302 to alternate between charging and discharging the example photo imaging member 302. In the illustrated example of FIG. 3A, the electrical source provides a DC bias or offset to the core 202.

In the illustrated example of FIG. 3A, the charge roller 200 is positioned in constant mechanical contact with the photo imaging member 302 and the bias roller 304. However, in some examples the photo imaging member 302 and/or the bias roller 304 do not make mechanical contact and/or selectively make mechanical contact with the charge roller 200. For example the charge roller 200 and/or the bias roller 304 may be retractable to reduce mechanical contact when print operations are not being performed, and/or the charge roller 200 may be out of mechanical contact with the photo imaging member 302 and/or the bias roller 304 to avoid mechanical damage.

In the illustrated example of FIG. 3A, charging the photo imaging member 302 occurs in two general processes: charging the charge roller 200 and discharging the charge roller 200. The example processes may operate simultaneously and/or in an alternating manner. As the photo imaging member 302 rotates toward the nip 310, the example photo imaging member 302 has a sustained voltage of about −50 V DC. In the example of FIG. 3A, the charge roller 200 charges the photo imaging member 302 to a voltage of about −1000 VDC. To this end, the example electrical source 306 charges the bias roller 304 to a DC voltage of about −1200 V (which includes the −1000 V charge to be applied to the photo imaging member 302 and a voltage drop over the outer layer 104).

The electrical source 308 applies to the core 202 a DC voltage bias of −1000 V and a peak-to-peak AC voltage of 1400 V at a frequency of 8 kilohertz (kHz). The example DC voltage offset is selected to be the voltage to which the charge roller 200 is to charge the example photo imaging member 302 (e.g., −1000 V). However, other DC voltage offsets may be selected based on the choice of charging configuration as described in more detail below and/or the thickness of the outer layer 104.

In some examples where the electrical source 308 applies an AC voltage to the core 202, the inner layer 204 is constructed to have a sufficiently high AC response time (e.g., a relatively low RC time constant). For example, when the electrical source 208 provides an AC voltage to the core 202, the inner layer 204 is about 5 mm thick, and the inner layer 204 is constructed using a material having a resistivity of about $1\times10^5$ Ohm-cm, the example inner layer 204 is also constructed to have a dielectric constant (static relative permittivity) of about 10,000 or higher. For example, the inner layer 204 may be constructed of Polyurethane rubber doped with a relatively small amount (e.g., a few percent) of carbon black, which provides short-distance conductivity without significantly changing the DC resistivity of the example Polyurethane.

As the charge roller 200 rotates, an example section 314 of the outer layer 104 approaches the nip 312 (e.g., a charge roller-bias roller interface). As the section 314 approaches the nip 312, the charge density at the section 314 increases due to the decrease in distance between the section 314 and the charged bias roller 304. Additionally, the distance between the section 314 and the bias roller 304 approaches the distance for the Paschen minimum breakdown voltage between the outer layer 104 and the bias roller 304. The Paschen minimum breakdown voltage is the lowest voltage between two surfaces with a fluid between them. A Paschen discharge may occur at or above the Paschen minimum breakdown voltage, which is the breakdown voltage at a corresponding Paschen minimum breakdown distance.

The voltage of the example core 202 changes according to the AC component of the electrical source 308. When the voltage of the example core 202 and, due to the electrical conductivity of the inner layer 204, the voltage of the inner surface 106 are higher than (e.g., farther from 0 V when the bias roller 304 is biased to a negative voltage) the voltage of the bias roller 304, the example section 314 attracts negative charges 316 onto the outer layer 104, thereby causing corresponding positive charges 318 to be attracted to the inner surface 106 from the core 202 and/or the inner layer 204.

In the illustrated example, the bias roller 304 deposits the negative charges 316 on the outer layer 104 (e.g., on the outer surface 108) via plasma discharge 320. The plasma discharge 320 of the illustrated example is an avalanche breakdown of the air between the charge roller 200 and the bias roller 304 that occurs when the voltage difference between the charge roller 200 and the bias roller 304 is greater than the Paschen minimum breakdown voltage between the outer layer 104 and the bias roller 304 at a given distance. As a result, the section 314 of the illustrated example is charged by the bias roller 304 via the plasma discharge 320 prior to reaching the nip 312. When the section 314 is sufficiently charged, the voltage difference between the section 314 and the bias roller 304 becomes less than the Paschen minimum breakdown voltage and the charging stops. At this time, the section 314 is considered charged. In some examples, multiple plasma discharges may occur before the section 314 is charged. Due to the dielectric properties of the example outer layer 104, the negative charges 316 transferred to the outer layer 104 do not dissipate, and instead remain on the section 314 as the charge roller 200 rotates.

Turning to an example photo imaging member 302 charging process, as an example charged section 322 of the outer layer 104 approaches the nip 310 (e.g., between the charge roller 200 and the photo imaging member 302), the charged section 322 approaches the Paschen minimum breakdown distance between the outer layer 104 and the photo imaging member 302. Additionally, while the example charge roller 200 rotates, the AC component of the example electrical source 308 increases and decreases the difference in voltage between the charged section 322 and the photo imaging member 302. When the charged section 322 is at or near the Paschen minimum breakdown distance, the voltage between the charged section 322 and the photo imaging member 302 becomes higher than the Paschen breakdown voltage (e.g., for the distance between the charged section 322 and the photo imaging member 302) and the charged section 322 discharges to charge the photo imaging member 302 via a Paschen discharge 324.

The discharge of the example charged section 322 and the charging of the example photo imaging member 302 reduces the voltage between them. In the illustrated example, the AC component of the example electrical source 308 also reduces the voltage between the charged section 322 and the photo imaging member 302. As a result, the example charged section 322 of FIG. 3A discharges multiple times to complete the charging of the photo imaging member 302. After discharging the charged section 322 and/or charging the photo imaging member 302, the portion of the photo imaging member 302 that was charged by the charged section 322 has a DC voltage of about −1000 V. An example of charging and discharging the photo imaging member 302 using an AC configuration is described below with reference to FIG. 4.

The net flow of charge between the example bias roller 304 and the example photo imaging member 302 of the illustrated example results in a current of about −0.6 mA at a photo imaging member speed of 1.2 m/s. Due to the high resistivity of the example outer layer 104, the charge transfer between the inner 106 and outer 108 surfaces of the outer layer 104 is less than 0.2 microamperes (μA), or less than 0.04 percent of the current transferred between the example bias roller 304 and the example photo imaging member 302. The example outer layer 104 may be considered to prevent or substantially prevent current flow when transferring between the surfaces 106 and 108 less than 1 percent of the current transferred between the bias roller 304 and the photo imaging member 302 in operation.

While example voltages and frequencies are described, other voltages and frequencies may be used to charge the photo imaging member 302 to a desired voltage based on the materials used and/or the geometries of the respective rollers 200, 302, 304. For example, the electrical source 306 may charge the bias roller 304 to a higher (e.g., more negative) DC voltage to increase (e.g., make more negative) the voltage to which the example photo imaging member 302 is charged.

Figure 4:
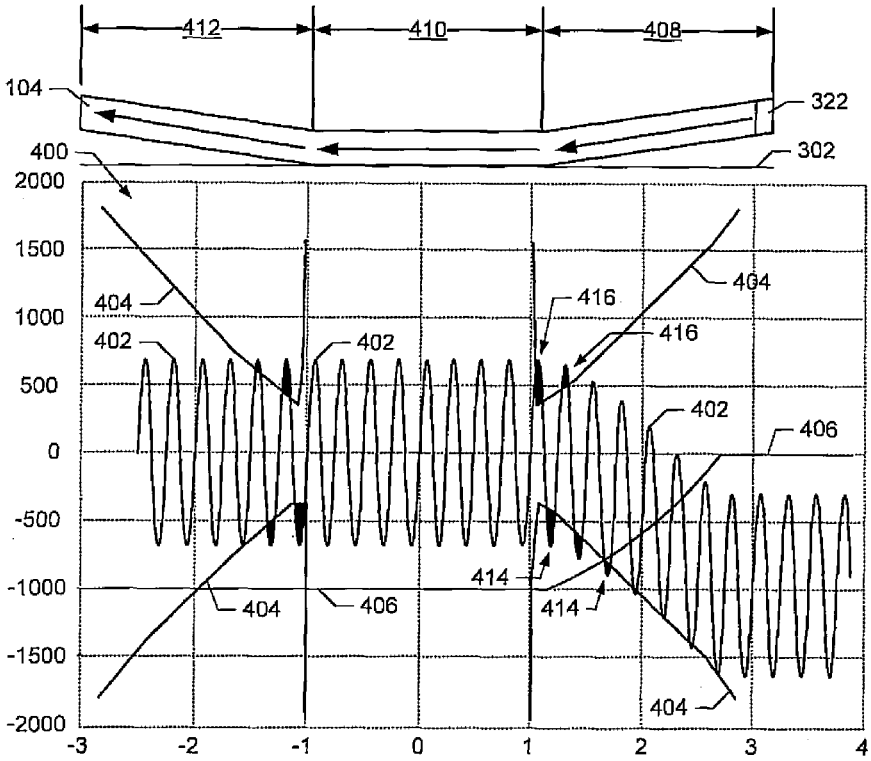
FIG. 4 is a graph of example voltages and currents of the example image forming apparatus of FIG. 3A while charging the photo imaging member.

FIG. 4 is a graph 400 of example voltages and currents of the example image forming apparatus 300 while charging the photo imaging member 302 of FIG. 3A in an AC charging configuration. The example graph 400 includes the voltage difference 402 between the example charge roller 200 (e.g., the outer surface) and the photo imaging member 302, the Paschen breakdown voltage 404 between the outer layer 104 of the charge roller 200 and the photo imaging member 302, and the voltage 406 of the photo imaging member 302. The example graph 400 illustrates the voltages 402-406 as a section (e.g., the example charged section 322 of FIG. 3A) of the outer layer 104 and a section of the photo imaging member 302 move from a pre-nip area 408 through a nip area 410 (e.g., the nip 310 of FIG. 3A) to a post-nip area 412 in the illustrated directions.

The example Paschen breakdown voltage 404 is the same voltage-to-distance relationship, but is shown in FIG. 4 to reflect that Paschen discharge may occur in both the pre-nip 408 and post-nip 412 areas, and/or may result in charge traveling from the charge roller 200 to the photo imaging member 302 (e.g., charging) and charge traveling from the photo imaging member 302 to the charge roller 200 (e.g., discharging). As discussed above, the example charge roller 200 is connected to the electrical source 308, which includes a DC component of −1000 V and a 1400 V peak-to-peak AC component at 8 kHz (e.g., 700 sin (2π*8000*t) V).

In the pre-nip area 408, the example photo imaging member 302 has a DC voltage of about −50 V (e.g., left by a charge eraser) and the DC component of the charge roller 200 is −1000 V. Accordingly, the example difference voltage 402 has a DC component of about −950 V. As the example section of the photo imaging member 302 moves through the pre-nip area 408, the Paschen breakdown voltage 404 decreases. When the voltage difference 402 between the photo imaging member 302 and the charge roller 200 increases above the Paschen breakdown voltage 404 in either the positive or negative directions, the charge roller 200 charges the photo imaging member 302 (e.g., when the voltage of the charge roller 200 is more negative than the voltage of the photo imaging member 302 as shown at reference numerals 414) or discharges the photo imaging member 302 (e.g., when the voltage of the photo imaging member 302 is more negative than the voltage of the charge roller 200 as shown at reference numerals 416) until the charge density of the example photo imaging member 302 is equal or approximately equal to the charge density on the outer surface 108 of the example charge roller 200. As the charge roller 200 charges the photo imaging member 302, the voltage 406 on the photo imaging member 302 increases (e.g., becomes more negative) until the voltage of the photo imaging member 302 is equal to or approximately equal to the desired voltage of −1000 V. The voltage 406 of the photo imaging member 302 is a function of the charge density and the thickness of the photo imaging member.

While the sections of the example charge roller 200 and the photo imaging member 302 travel through the nip area 410, the photo imaging member 302 is not charged or discharged. When the sections of the example charge roller 200 and the example photo imaging member 302 exit the nip area 410 and travel through the post-nip area 412, the charge roller 200 may again charge and/or discharge the photo imaging member 302. As illustrated in the example graph 400, the section of the photo imaging member 302 is charged to the desired voltage (e.g., −1000 V) prior to entering the nip area 410 and, thus, little or no additional charging or discharging occurs in the post-nip area 412 in the illustrated example.

Due to the Paschen discharge mechanism used by the example configuration illustrated in FIG. 3A, additional charge on the charge roller 200 beyond what is needed to charge the photo imaging member 302 to the desired voltage will remain on the charge roller 200. To change the voltage to which the example charge roller 200 charges the example photo imaging member 302, the voltage supplied by the example electrical source 306 to the bias roller 304 of FIG. 3A is adjusted. In the example of FIG. 3A, the voltage difference between the bias roller 304 and the charge roller 200 controls the charge density on the outer layer 104. The voltage applied to the bias roller 304 determines the charge density and/or voltage applied to the photo imaging member 302.

Figure 3B:
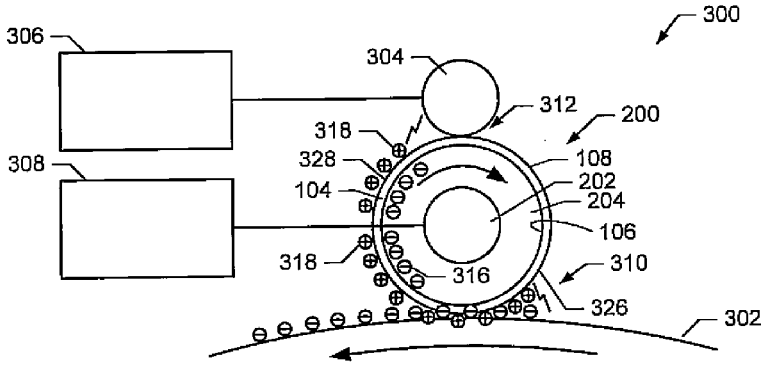
FIG. 3B illustrates the image forming apparatus of FIG. 3A in another example charging configuration.

FIG. 3B illustrates the example image forming apparatus 300 using another example configuration, the electrical source 306 provides a first DC bias to the bias roller 304 (e.g., −2200 V, which includes a −1000 V charge to be applied to the photo imaging member 302, a −200 V voltage drop over the outer layer 104, and the Paschen minimum breakdown voltages between the bias roller-charge roller (400 V) and charge roller-photo imaging member (600 V) interfaces) and the electrical source 308 provides a second DC bias to the core 202 (e.g., −1800 V, which includes the −1000 V charge to be applied to the photo imaging member 302, a −200 V voltage drop over the outer layer 104, and the Paschen minimum breakdown voltage between the charge roller-photo imaging member (600 V) interface). In this example, the difference in voltage between the bias roller 304 and the charge roller 200 is equal to or less than the Paschen minimum breakdown voltage and, thus, the bias roller 304 does not deposit charge on the outer surface 108 as in the example above. Instead, when an example section 326 approaches the Paschen minimum breakdown distance prior to entering the nip 310, the photo imaging member 302 discharges positive charges 318 onto the section 326. As a result, negative charges 316 (e.g., a voltage of about −1000 V) remains on a discharged portion of the example photo imaging member 302.

Continuing with the example, the example section 326 carries the positive charges toward the bias roller 304 as the charge roller 200 rotates. An example charged section 328, carrying positive charges 318 transferred from the photo imaging member 302, has a lower voltage than the example core 202 as a result of the positive charges 318 and, thus, the voltage difference between the charged section 328 and the bias roller 304 is larger than the Paschen minimum breakdown voltage. As the example charged section 328 approaches the bias roller 304, the charged section 328 discharges the positive charges 318 to the bias roller 304 via a Paschen discharge. In this manner, the example charge roller 200 charges the photo imaging member 302 by removing positive charges to the bias roller 304 instead of depositing negative charges onto the photo imaging member 302.

In another example configuration, the electrical source 306 of FIG. 3B provides a DC voltage to the bias roller 304 and the electrical source 308 provides an AC voltage with a DC bias to the core 202. To charge the photo imaging member 302 to −1000 V, the example electrical source 306 provides a DC voltage of about −1200 V (e.g., including the −1000 V charge to be applied to the photo imaging member 302 and a −200 V voltage drop over the outer layer 104) and the example electrical source 308 provides an AC voltage of about 1400 V peak-to-peak with a DC offset voltage of about −1200 V (e.g., which includes the −1000 V charge to be applied to the photo imaging member 302 and a −200 V voltage drop over the outer layer 104).

Continuing with the example, the portion 326 of the charge roller 200 receives positive charges 318 from the photo imaging member 302 (e.g., via a first Paschen discharge) as the portion 326 exits the nip 310. The example charged section 328, which has positive charges 318 transferred from the photo imaging member 302, carries the positive charges 318 toward the bias roller 304. The positive charges 318 increase the voltage difference between the bias roller 304 and the charge roller 200 beyond the Paschen minimum breakdown voltage. As a result, a Paschen discharge occurs and the positive charges 318 are removed from the example charged section 328 to the bias roller 304 (e.g., via a second Paschen discharge).

While some example charging configurations are described above, other configurations may additionally or alternatively be used. For example, the DC bias applied to the charge roller core 202 by the electrical source 208 (if any) is described in the examples above as between the voltage to which the photo imaging member 302 is charged and the bias voltage of the bias roller 304. However, in some other example configurations the DC bias applied to the charge roller core 202 is less than the charged voltage of the photo imaging member 302 or greater than the DC bias of the bias roller 304. Such configurations may result in more uniform charging of the photo imaging member 302.

Figure 5:
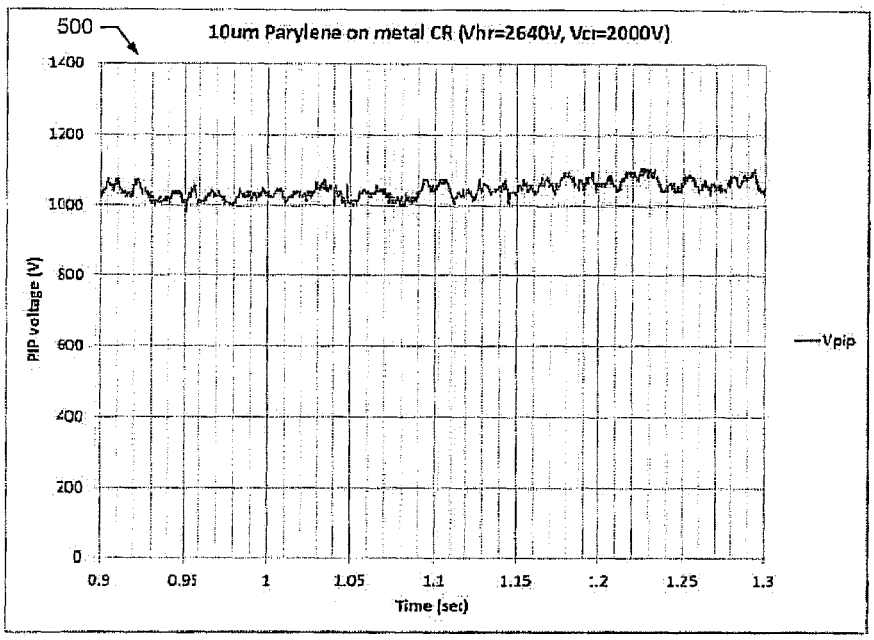
FIG. 5 is a graph of results of an example test demonstrating that the example outer layer of FIGS. 1 and 2 prevents pinholes when the example inner layer has a high conductivity.

The example outer layer 104 of FIGS. 1, 2, and 3 were tested to determine whether the outer layer 104 would suffer from pinholes if a highly conductive inner layer is used. The more conductive the inner layer is, the more evenly the charge is applied to the photo imaging member and the greater the likelihood of pinholing as current can relatively easily traverse a more conductive inner layer and enlarge any pinholes that have been created. Example results 500 illustrated in FIG. 5 demonstrate that the example outer layer 104 does not suffer from pinholes, even when a material having a very low resistivity is used for the inner layer. In the test from which the results 500 were generated, the example inner layer 102 of FIG. 1 was constructed using aluminum (approximately $3\times10^{-6}$ Ohm-cm resistivity). The outer layer 104 was constructed using a 10 μm-thick layer of Parylene-N over the inner layer 102. The charge roller and the photo imaging plate of the example test were positioned 50 μm apart to prevent mechanical damage to the outer layer from being compressed between two hard materials (the aluminum inner layer and the photo imaging plate). While an inner layer constructed of aluminum can provide good charging uniformity, softer materials are advantageously used in some examples to prevent mechanical damage to one or both of the outer layer and the photo imaging plate.

Pinholes are more likely to form in materials having lower resistances. An example outer layer constructed using Parylene-N has a resistivity of at least $10^{16}$ Ohm-cm, which is a sufficiently high resistivity to prevent pinholing when the outer layer is 10 μm thick, as demonstrated by the example results 500, or when the outer layer is 3 μm thick. The example 3 μm-thick layer of Parylene-N used in the example outer layer 104 of FIG. 3A also prevented pinholing, even when the charge roller 200 and the photo imaging member 302 were brought into physical contact. While mechanical damage occurred due to the hardness of both the charge roller 200 and the photo imaging member 302, pinholing did not occur. Because a more conductive inner layer is likely to achieve more uniform charging of the photo imaging member, and the outer layer allows for more conductive materials to be used, the example outer layer 104 of FIGS. 1, 2, and 3 allows for good charging uniformity and improved print quality.

Figure 6:
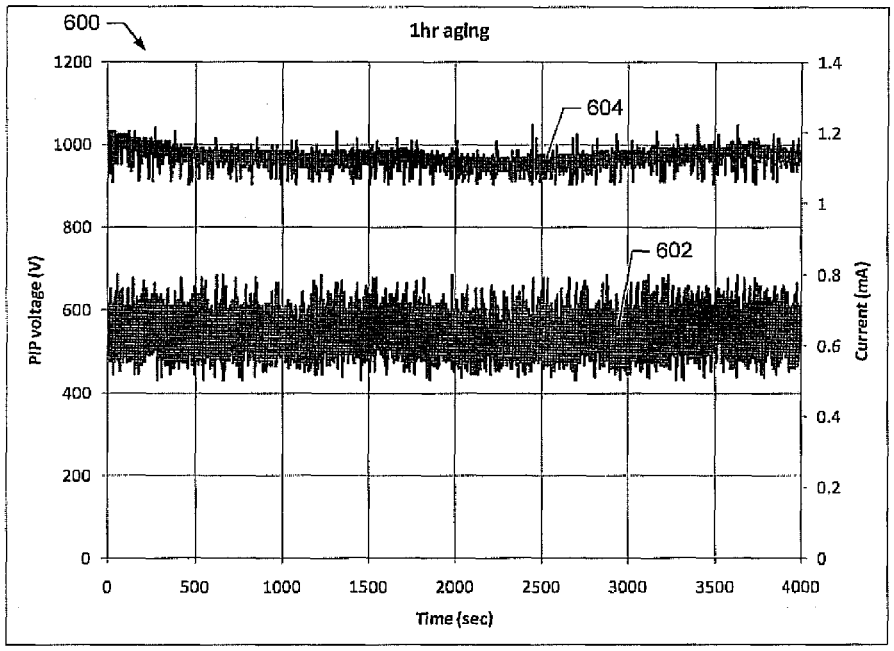
FIG. 6 is a graph of results of an example test to determine whether the example outer layer of FIGS. 1 and 2 undergoes electrical aging during operation of the example image forming apparatus of FIG. 2.

The example charge roller 200 of FIGS. 2 and 3 was subjected to a one hour aging test using the example AC configuration illustrated in FIG. 3A. Results 600 of the example aging test are presented in FIG. 6. As shown in the example results 600, the average current 602 transferred from the bias roller (e.g., the example bias roller 304 of FIGS. 2 and 3) did not noticeably change during the one-hour test, which indicates that the example outer layer 104 did not suffer from electrical aging. If aging had occurred, the average current 602 would have noticeably increased during the test period. Additionally, the photo imaging member voltage 604, measured on sections of the tested photo imaging member (e.g., the photo imaging member 302 of FIG. 3A) 100 ms after the respective sections exit the nip 310, did not noticeably decrease (after a 50 V drop in the initial 500 seconds, which is the result of a known phenomenon and can be compensated) during the test. While the voltage 604 varied during the life of the test, there was no noticeable net drop in the voltage 604 by the conclusion of the test, which also indicates that the outer layer 104 did not suffer from electrical aging.

Figure 7:
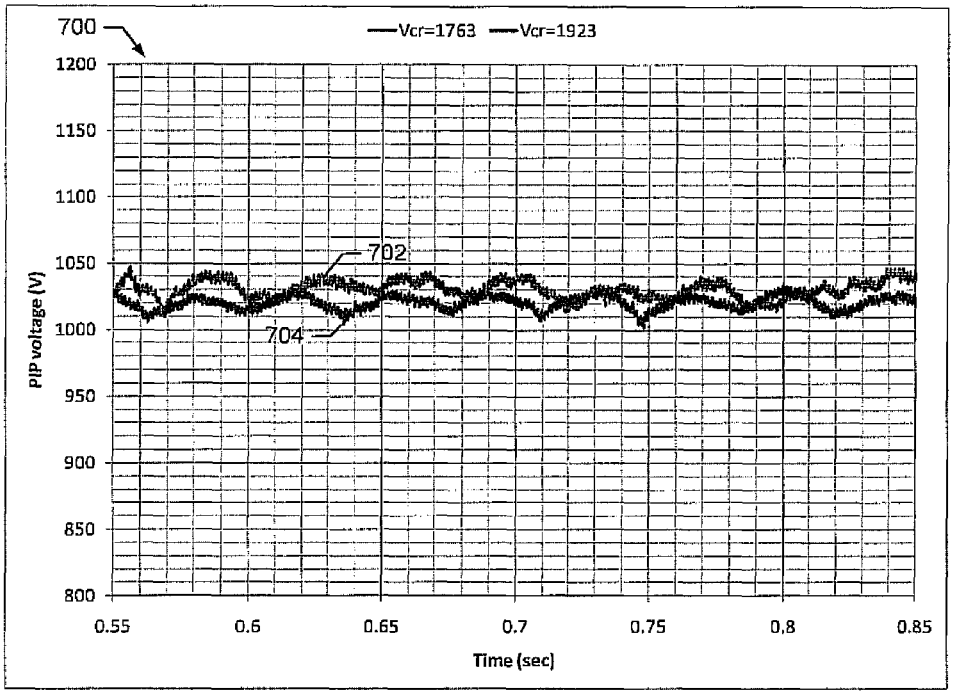
FIG. 7 is a graph of results of an example test operation of the example image forming apparatus of FIGS. 3A and 3B using direct current electrical sources to charge a photo imaging member.

FIG. 7 is a graph of results 700 of an example test using the example image forming apparatus 300 of FIG. 3A and configured to use direct current for the electrical sources 306 and 308. The example results 700 include a first voltage 702 of the photo imaging member 302 when the electrical source 308 provided a DC voltage of −1763 V to the core 202, and a second voltage 704 of the photo imaging member 302 when the electrical source 208 provided a DC voltage of −1923 V to the core 202. In both examples, the electrical source 206 provided a DC voltage of −2328 V to the bias roller 304. As demonstrated in the example graph 700, the voltage applied to the core 202 of the charge roller 200 had little or no effect on the average voltage to which the photo imaging member 302 is charged. Instead, the voltage of the bias roller 304 controls the voltage of the photo imaging member 302.

Figure 8:
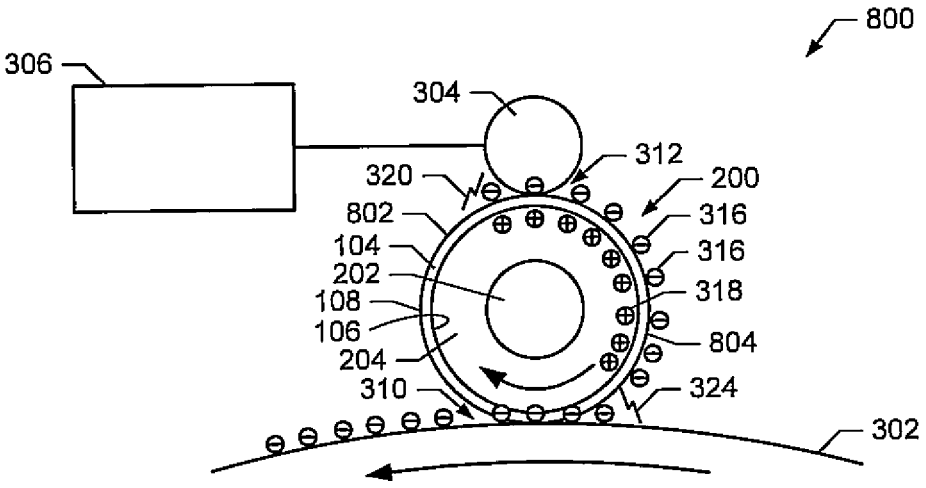
FIG. 8 illustrates an example image forming apparatus including the charge roller of FIG. 2 using a direct current electrical source to charge a photo imaging member.

FIG. 8 illustrates an example image forming apparatus 800 including the charge roller 200 of FIG. 2 in a DC charging configuration. The example image forming apparatus 800 includes the example charge roller 200, the example photo imaging plate 302, the example bias roller 304, and the example electrical source 306 of FIG. 3A. In contrast to the example image forming apparatus 300 of FIG. 3A, the illustrated example image forming apparatus 800 does not have an electrical source connected to the core 202 and, instead, allows the core 202 to be electrically floating (e.g., not tied to any constant voltage potential). To compensate for the floating core 202, the electrical source 306 increases the DC voltage of the bias roller 304 to about −2300 V to charge the photo imaging member 302 to −1000 V.

The example image forming apparatus 800 will be discussed with reference to an example section 802 of the outer layer 104 to be charged by the bias roller 304 and an example charged section 804 of the outer layer 104 to be discharged to charge the photo imaging member 302. As in the example image forming apparatus 300 of FIG. 3A, the example charge roller 200 rotates in response to the contact with the rotating photo imaging member 302. As a result, the section 802 rotates toward the nip 312 between the bias roller 204 and the charge roller 200, and the charged section 804 rotates toward the nip 210 between the charge roller 200 and the photo imaging member 302.

As the section 802 rotates toward the nip 312, the distance between the section 802 and the bias roller 304 approaches the Paschen minimum breakdown distance. Due to the relatively high voltage between the (discharged) section 802 and the bias roller 304, a Paschen discharge may occur prior to the section 802 reaching the Paschen minimum breakdown distance. The Paschen discharge charges the section 802 to a negative voltage approximately equal to the voltage of the bias roller (e.g., −2300 V), less the Paschen breakdown voltage between the bias roller 304 and the outer layer 104. The voltage of the example section 802 is further reduced by a voltage drop between the inner 106 and outer 108 surfaces of the outer layer 104 at the section 802 during charging. While charging of the section 802 may begin before the section 802 reaches the Paschen minimum breakdown distance, the charging is generally completed by the time the section 802 passes the Paschen minimum breakdown distance.

Compared to the example AC configuration of FIG. 2, the bias roller 304 may overcharge and/or undercharge the section 802 and/or portions of the section 802. The bias roller 304 does not correct overcharging or undercharging when the section 802 has passed the Paschen minimum breakdown distance because the Paschen breakdown voltage becomes larger than the voltage between the section 802 and the bias roller 304. However, voltage variations in example tests were within acceptable limits for desired print quality.

In the illustrated example, the voltage of the section 802 after charging is approximately equal to the sum of: the desired voltage to which the photo imaging plate is to be charged; the Paschen breakdown voltage between the outer layer 104 and the photo imaging member 302; the Paschen breakdown voltage between the outer layer 104 and the bias roller 304; and the voltage drop between the inner 106 and outer 108 surfaces of the outer layer 104 at the section 802 resulting from deposited charges 316 and 318. Thus, to charge the example photo imaging plate 302 to −1000 V, the example section 802 is charged by the bias roller 304 to approximately −2260 V.

When the example charged section 804 approaches the nip 310, the distance between the charged section 804 and the photo imaging member 302 approaches the Paschen minimum breakdown distance. Similar to the charging of the example section 802 by the bias roller 304, the example charged section 804 begins charging the photo imaging member 302 prior to the Paschen minimum breakdown distance due to the voltage between the charged section 804 and the photo imaging member 302 being higher than the Paschen minimum breakdown voltage. In the illustrated example, the charged section 804 discharges to charge the photo imaging member 302 and completes charging the section 806 by the time the charged section 804 passes the Paschen minimum breakdown distance.

Compared to the AC configuration described with reference to FIG. 3A, the example charged section 804 may overcharge and/or undercharge the photo imaging member 302 and/or portions of the photo imaging member 302. The charged section 804 does not correct overcharging or undercharging when the section 802 has passed the Paschen minimum breakdown distance because the Paschen breakdown voltage becomes larger than the voltage between the section 802 and the bias roller 304. However, voltage variations observed in tests of the example apparatus 800 were within acceptable limits for desired print quality.

While charging is described as occurring prior to the photo imaging member 302 and the section 802 entering the respective nips 310 and 312, the example photo imaging member 302 and the example section 802 may also be charged after exiting the nips 310 and 312. For example, as the charge roller 200 continues to rotate, the distance between the section 802 and the bias roller 304 again approaches the Paschen minimum breakdown distance after the section 802 exits the nip 312. If the section 802 and/or portions of the section 802 are undercharged, additional Paschen discharge may occur to further charge the section 802 to the appropriate voltage. The example photo imaging member 302 may be similarly charged by the charged section 804 after exiting the nip 310.

While the examples described above include example materials and operate at example voltages, currents, and/or frequencies, the materials, voltages, currents, and/or frequencies may be modified to suit a particular application. For example, while the charge rollers described above are discussed with reference to charging a photo imaging member to −1000 V, the charge roller may be used to provide other voltages and/or charge densities to other external surfaces, in which case any of the sizes, voltages, currents, frequencies, materials, and/or other aspects of the example charge rollers may be modified. As another example, constructing the example outer layer of the example charge roller using a different material may cause a change in the Paschen breakdown voltage between the outer layer and the external surface. In such a case, any of the sizes, voltages, currents, frequencies, materials, and/or other aspects of the charge roller may be modified to charge the external surface to a desired voltage.

The above-disclosed example charge rollers and image forming apparatus including the charge rollers provide a substantially uniform charge to a photo imaging member surface. While the example AC configuration described in conjunction with FIGS. 3A and 4 may provide relatively better uniformity of charging on the photo imaging plate, the example configuration illustrated in FIG. 8 uses fewer electrical sources and may be less expensive to implement in an image forming apparatus such as a printer. The above-disclosed example charge rollers and image forming apparatus have a significantly longer operating life than known charge rollers. In contrast to some known charge rollers, the example charge rollers described herein provide significantly longer operating life and substantially uniform charging of external surfaces, without suffering from problems or destructive effects known to occur in the known charge rollers with some of the materials used in the examples or materials similar in relevant characteristics to those materials.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A charge roller, comprising:

a dielectric outer layer comprising an inner surface and an outer surface, the outer surface to be charged by a first external surface and to discharge onto a photoconductor surface, and the dielectric outer layer to substantially prevent charge transfer between the inner surface and the outer surface; and an electrically conductive inner layer to direct electrical charge toward and away from the inner surface of the outer layer, and to be coupled to an electrical source to control a transfer of the electrical charge.

2. A charge roller as defined in claim 1, wherein the inner layer comprises at least one of an electrically conductive rubber or a metal.

3. A charge roller as defined in claim 1, wherein the outer layer comprises para-xylylene or a derivative of para-xylylene.

4. A charge roller as defined in claim 1, wherein the outer layer is to conduct between the inner surfaces less than about 1 percent of current transferred from the first external surface to the photoconductor surface.

5. A charge roller as defined in claim 1, wherein the inner layer is to be biased with at least one of an alternating current or a direct current.

6. A charge roller as defined in claim 1, wherein the outer layer is less than 12 micrometers thick.

7. A charge roller as defined in claim 1, wherein the inner layer has a dielectric constant of at least 10,000.

8. A charge roller as defined in claim 1, wherein the outer layer has a resistivity greater than $5\times10^{12}$ Ohm-centimeters and a dielectric breakdown strength greater than 100 Volts/micrometer.

9. A charge roller as defined in claim 1, wherein the outer surface is to discharge onto the electrical charge to generate a substantially uniform voltage across the photoconductor surface.

10. A charge roller as defined in claim 1, wherein the outer surface is to be charged at a first rotational position via a first Paschen discharge and is to discharge at a second rotational position via a second Paschen discharge.

11. A charge roller as defined in claim 10, wherein the outer surface is to be repeatedly charged at the first rotational position and repeatedly discharged at the second rotational position as the outer surface is rotated.

12. An image forming apparatus, comprising:

a photo imaging surface to receive an electrical charge during imaging operations of the image forming apparatus;

a bias roller to supply the electrical charge; and a charge roller having a conductive inner layer and a dielectric outer layer to transfer the electrical charge between the bias roller and the photo imaging surface, wherein the dielectric outer layer is to prevent substantial current from flowing between the bias roller and the conductive inner layer, and the conductive inner layer is to be coupled to a first electrical source to control a transfer of the electrical charge.

13. An apparatus as defined in claim 12, wherein the charge roller is to transfer the electrical charge to generate a substantially uniform voltage across the photo imaging surface.

14. An apparatus as defined in claim 12, further comprising a second electrical source to provide an alternating current voltage to the inner layer, wherein the first electrical source is to provide a direct current voltage to the bias roller to supply or receive the electrical charge.

15. An apparatus as defined in claim 12, wherein the dielectric outer layer limits current through the dielectric outer layer to less than 1 percent of current transferred between the bias roller and the photo imaging surface.

16. An apparatus as defined in claim 12, wherein the dielectric outer layer is less than about 12 micrometers thick.

17. An apparatus as defined in claim 12, wherein the inner layer has a dielectric constant of at least 10,000.

18. An apparatus as defined in claim 12, wherein the outer layer includes para-xylylene or a derivative of para-xylylene.

19. A method, comprising:

transferring a charge from a first one of a charge source or a photoconductor surface to a dielectric outer layer of a charge roller via a first Paschen discharge;

rotating the charge roller; and transferring the charge from the dielectric outer layer of the charge roller to the other of the photoconductor surface or the charge source via a second Paschen discharge.

20. A method as defined in claim 19, wherein the dielectric outer layer has a resistivity greater than or equal to about $5\times10^{12}$ Ohm-centimeter and a dielectric breakdown strength greater than or equal to about 100 Volts/micrometer.

* * * * *

UNITED STATES PATENT AND TRADEMARK OFFICE

CERTIFICATE OF CORRECTION

PATENT NO. : 9,037,045 B2
APPLICATION NO. : 13/981861
DATED : May 19, 2015
INVENTOR(S) : Omer Gila et al.

It is certified that error appears in the above-identified patent and that said Letters Patent is hereby corrected as shown below:

In the Claims

In column 14, line 21, in Claim 4, delete "inner" and insert -- inner and outer --, therefor.

Signed and Sealed this
Thirteenth Day of October, 2015

Michelle K. Lee

Michelle K. Lee
*Director of the United States Patent and Trademark Office*